US011408185B2

(12) United States Patent
Romanello, Jr.

(10) Patent No.: US 11,408,185 B2
(45) Date of Patent: Aug. 9, 2022

(54) TILE INSTALLATION TEMPLATE

(71) Applicant: Joseph John Romanello, Jr., New Fairfield, CT (US)

(72) Inventor: Joseph John Romanello, Jr., New Fairfield, CT (US)

( * ) Notice: Subject to any disclaimer, the term of this patent is extended or adjusted under 35 U.S.C. 154(b) by 1435 days.

(21) Appl. No.: 15/414,841

(22) Filed: Jan. 25, 2017

(65) Prior Publication Data

US 2020/0332536 A1 Oct. 22, 2020

(51) Int. Cl.
*E04F 21/00* (2006.01)
*E04F 21/04* (2006.01)
*E04F 21/20* (2006.01)

(52) U.S. Cl.
CPC ..... *E04F 21/04* (2013.01); *E04F 21/20* (2013.01)

(58) Field of Classification Search
CPC . E04F 21/04; E04F 21/10; E04F 21/02; E04F 21/023; E04F 21/026; E04F 21/05
USPC ..... 33/526, 527
See application file for complete search history.

(56) References Cited

U.S. PATENT DOCUMENTS 2,852,932 A * 9/1958 Cable ..... E04F 15/08 52/385
6,729,035 B1 * 5/2004 Carrillo ..... E04F 21/0076 33/526
6,834,438 B1 * 12/2004 Heister ..... E04F 21/0076 33/1 B
10,486,331 B1 * 11/2019 Maltese ..... B28B 7/22
2006/0005910 A1 * 1/2006 Jones ..... E04F 21/04 156/71
2013/0327465 A1 * 12/2013 Borusheski ..... E04F 21/1844 156/71

* cited by examiner

*Primary Examiner* — William V Gilbert

(74) *Attorney, Agent, or Firm* — Ware, Fressola, Maguire & Barber LLP

(57) ABSTRACT

The "Tile Installation Template" provides a total room accurate tile layout in a matter of minutes. The "Template" is a thin sheet of bendable plastic that has colored grout lines imprinted upon it for placement of tiles.

The invention is used for installing ceramic tiles and provides tile cut measurements to guarantee an accurate centered layout.

The Template has checker board type lines printed thereon. The lines are configured to replicate actual size of tiles and width of grout areas. The lines also contain ruler measurements to provide tile cut sizes.

The Template is laid on the floor, centered and trimmed so each end across from the other has approximately the same measurement against its endpoint (wall) thus guaranteeing an accurate layout. The Template is secured with large head nails or staples. The Template also contains holes to allow the glue to adhere to the tile and the floor.

4 Claims, 4 Drawing Sheets

TILE INSTALLATION TEMPLATE

CROSS-REFERENCE TO RELATED APPLICATIONS

None.

BACKGROUND OF THE INVENTION

A. Field of the Invention

The present invention relates generally to the field of flooring and more specifically to simplifying the installation process of tile flooring.

B. Description of the Related Act

Planning and designing a tile layout is critical to the success of a tile installation project. To create a professional looking tile floor, the project must have a precise, centered and accurate layout. The most significant aspect of a precise and accurate tile layout is to first determine the center of the room/area.

In order to locate the exact center of the room, which again is critical for correct tile installation, the installer must measure/calculate the entire length and width of the area to be tiled and then divide those calculations by calculating the area of full plus the total area of the grout areas between each tile. The object/requirement is to calculate the tile plus grout line measurement against the entire length and width measurements. In virtually all cases the end/edge tiles will need to be cut to fit perfectly against the end/edge of the room/area being tiled. To ensure a professional look the installer then shifts the center point of both the length and the width so each end/edge tile across from the other has as close to the same cut measurement as the other. This process must be precise and the understanding and know-how of this imperative, lengthy and extremely difficult process is mainly only understood and practiced by professional tile installers and contractors. For this reason, tile installation by homeowners is extremely difficult and time consuming and therefore mainly left to professionals. Once the center point is determined the installer commences laying his tiles from the center area of the room and works the installation out to towards the end of the area being tiled or in most cases the wall of the room. While laying these tiles the installer must also then rely upon tile spacers in order to ensure that the tiles do not shift throughout the installation process. The problem with tile spacers is that they are not fixed to the existing flooring and many inexperienced tile installers will start to skew its installation as well as vary the width of the areas which will need to be grouted.

Moreover, if the center of the room is calculated incorrectly or if the spacers skew off line, the tiles will need to be adjusted in both directions which takes a substantial amount of time and in many cases installers are then forced to remove the tiles previously installed and start the process from the beginning. Finally, as previously mentioned, under the present process for installing tiles the installer must commence laying the tiles from the center point of the area of the room. This process makes it difficult, especially for homeowners, because installers (in some instances) have to walk across tiles which are not completely adhered to the floor due to the tile glue not being completely dried. If this occurs, tiles do not adhere correctly to the floor and due to any normal wear and tear and/or house shifting the tiles will end up cracking after the job is completed.

Professionals and experienced tradesman waste a considerable amount of time on this initial critical step of a tile installation project. Furthermore, the majority of homeowners are not even aware of the need to center a room, nor have the understanding or know-how, prior to beginning the process of tile installation. In many cases homeowners instead make the mistake of starting the installation process by laying ceramic tiles against the wall or the edge of the area being tiled. This crucial mistake inevitably leads to a skewed inaccurate tile layout which results in a disappointing uneven and visually unappealing tiled floor.

C. Objects

It is an object of the present invention to provide a Template for tile installation that is simple and time efficient for professional installers as well as homeowners and inexperienced installers. The Template also ensures that tile placement is accurate and centered thus creating a professional looking tile job. The present invention takes the critical, time-consuming and difficult task of figuring out the center point of a room/area completely out of the equation. This allows homeowners the opportunity to install their own tiles and also helps contractors save much needed time previously wasted in locating and calculating the center point of the room/area.

SUMMARY OF THE INVENTION

The present invention is designed to accomplish the following: ensures the installation of installing tile is as simplified and as time efficient as possible when it comes to locating the center point of a room (thus establishing a starting point which is imperative to ensure an accurate layout); ensures the tiles being installed do not start to angle/skew one way or the other as they are being installed; allows the installer to keep all grout line widths exactly the same by following the pattern imprinted on the tile grid; provides the end/edge tile(s) measurements even without the use of a tape measure; enables professional installers and homeowners to locate the center of the room in a matter of minutes, thereby saving time for professionals and simplifying and virtually guaranteeing the correct installation process for a homeowner; and allows professional installers and homeowners to commence tiling from their desired location rather than the center point of the room/area.

BRIEF DESCRIPTION OF THE DRAWINGS

The accompanying drawings form a part of the specification and are to be read in conjunction herewith, in which like reference numerals are employed to indicate like or similar parts in the various views, and wherein.

DETAILED DESCRIPTION OF THE INVENTION

The following detailed description of the invention references the accompanying drawing figures that illustrate specific embodiments in which the invention may be practiced. The embodiments are intended to describe aspects of the invention in sufficient detail to enable installers to practice the invention. Other embodiments may be utilized and changes may be made without departing from the scope of the present invention. The present invention is defined by the appended claims and, therefore, the description is not to be taken in a limiting sense and shall not limit the scope of equivalents to which such claims are entitled.

Figure 1:
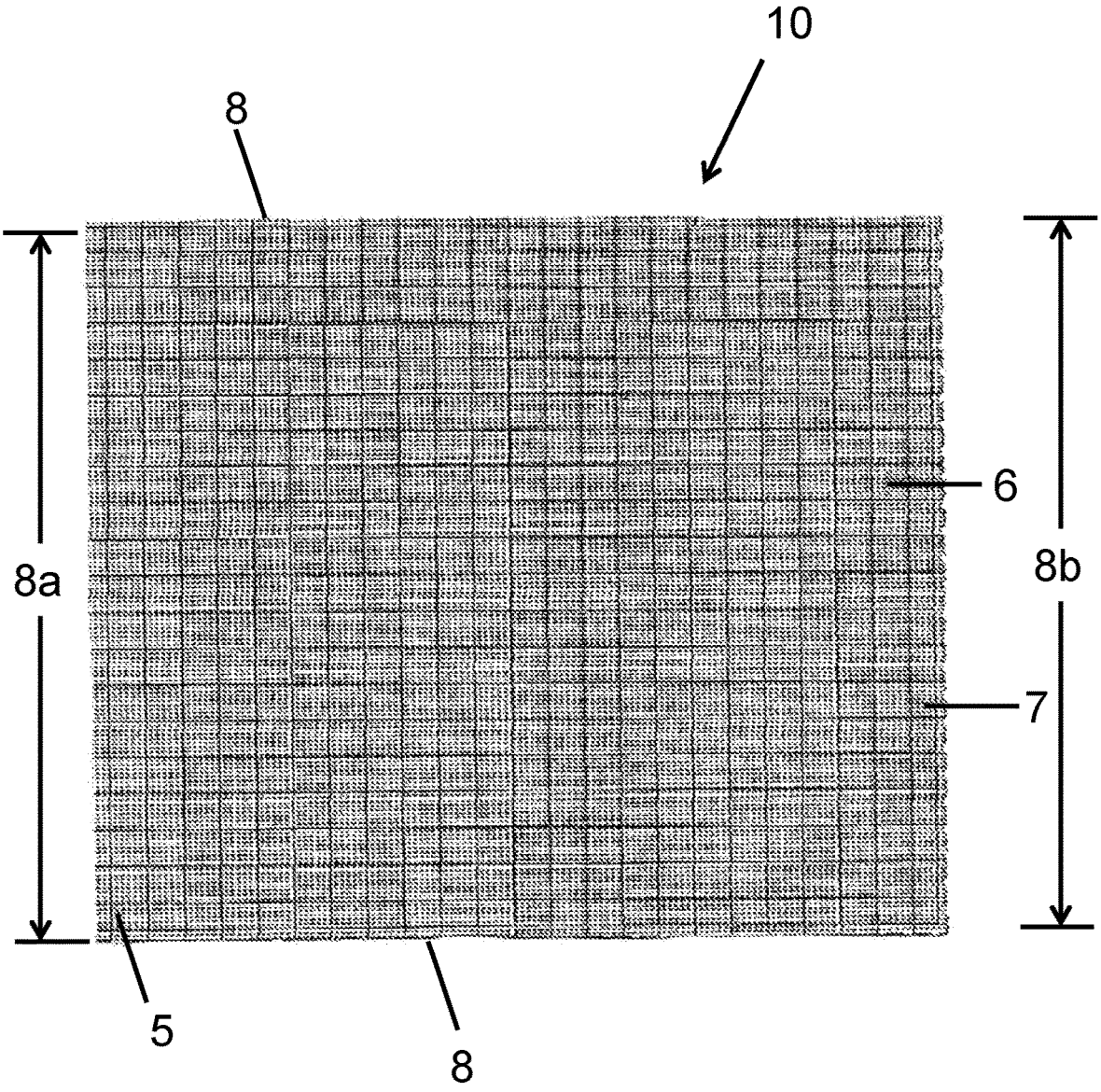
FIG. 1 is a front view of the tile installation Template according to the present invention.

The present invention is directed toward a Template 10 for laying and installing ceramic tile on floors (and in some cases walls) in commercial or residential settings. As illustrated in FIG. 1, the present invention will consist of a thin sheet of bendable plastic that has horizontal and vertical colored grout lines 5 imprinted upon it for the placement of tiles and grout line areas. The Template 10 will also have tile spaces 6 allotted for accurate tile placement. Each individual tile space 6 will have factory cut holes 7 spread evenly throughout the tile area to allow the tile glue and tile to bond to the floor. The Template 10 will be produced in various lengths and widths that are cut approximately one to two feet larger than common room sizes, such as 5'×7', 8'×8', 10'×10', 12'×12', 15'×15', 20'×20' etc. Any tile Template 10 cut larger than the area being tiled can be utilized by cutting the tile Template 10 down to the size of the area being tiled. The colored grout lines 5 imprinted upon the Template will also vary in size based upon the size of the tile ($L_1 \times L_2$) to be installed such as 6"×6", 6"×8", 8"×8", and 12"×12". Finally, the grout lines will also have a few variations of sizes (W) (ranging from 1/16" to 1/2") based upon width of the grout desired by the installer.

Figure 2:
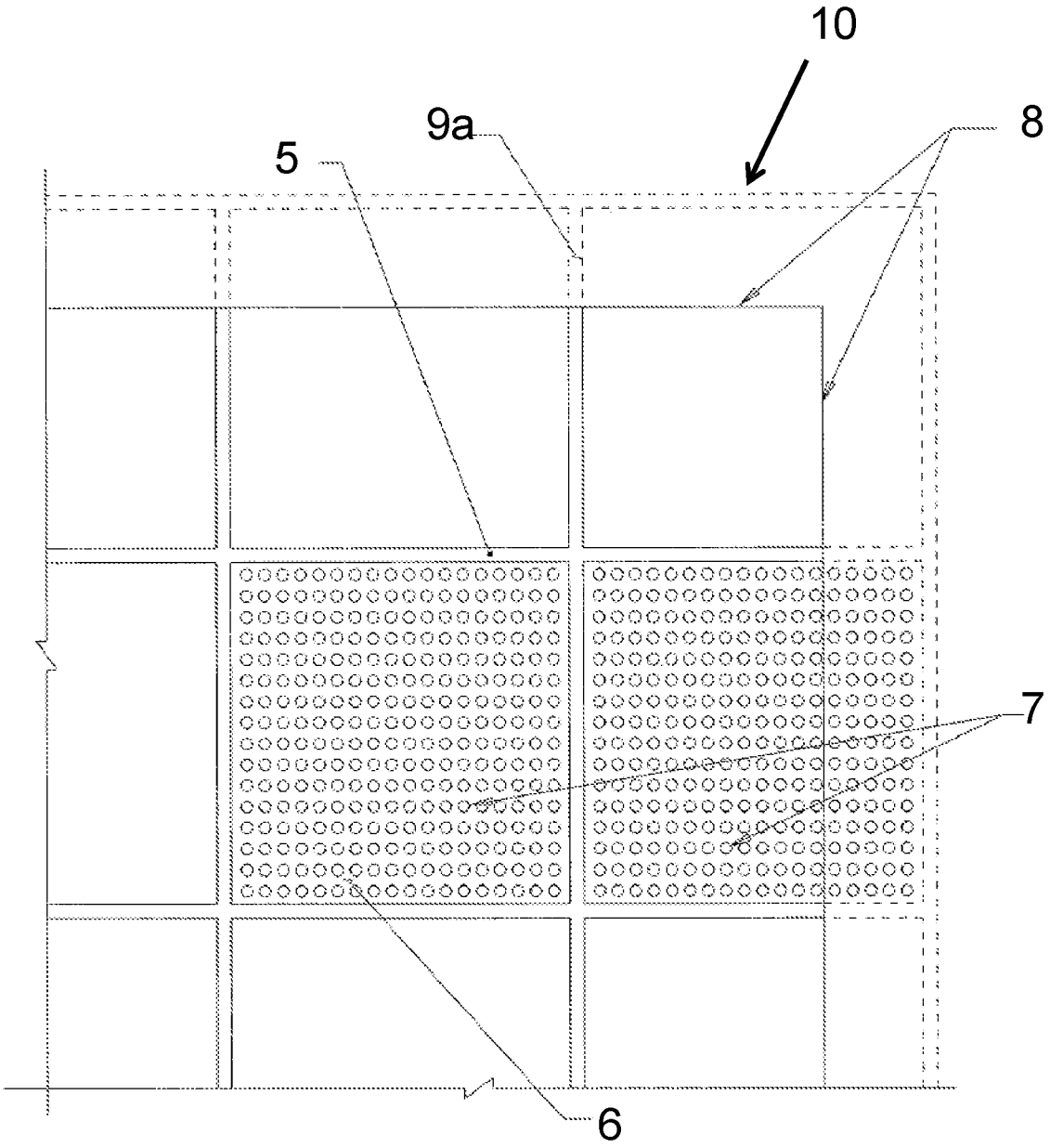
FIG. 2 is a partial perspective view of the tile Template being applied to the floor of a room.
Figure 3:
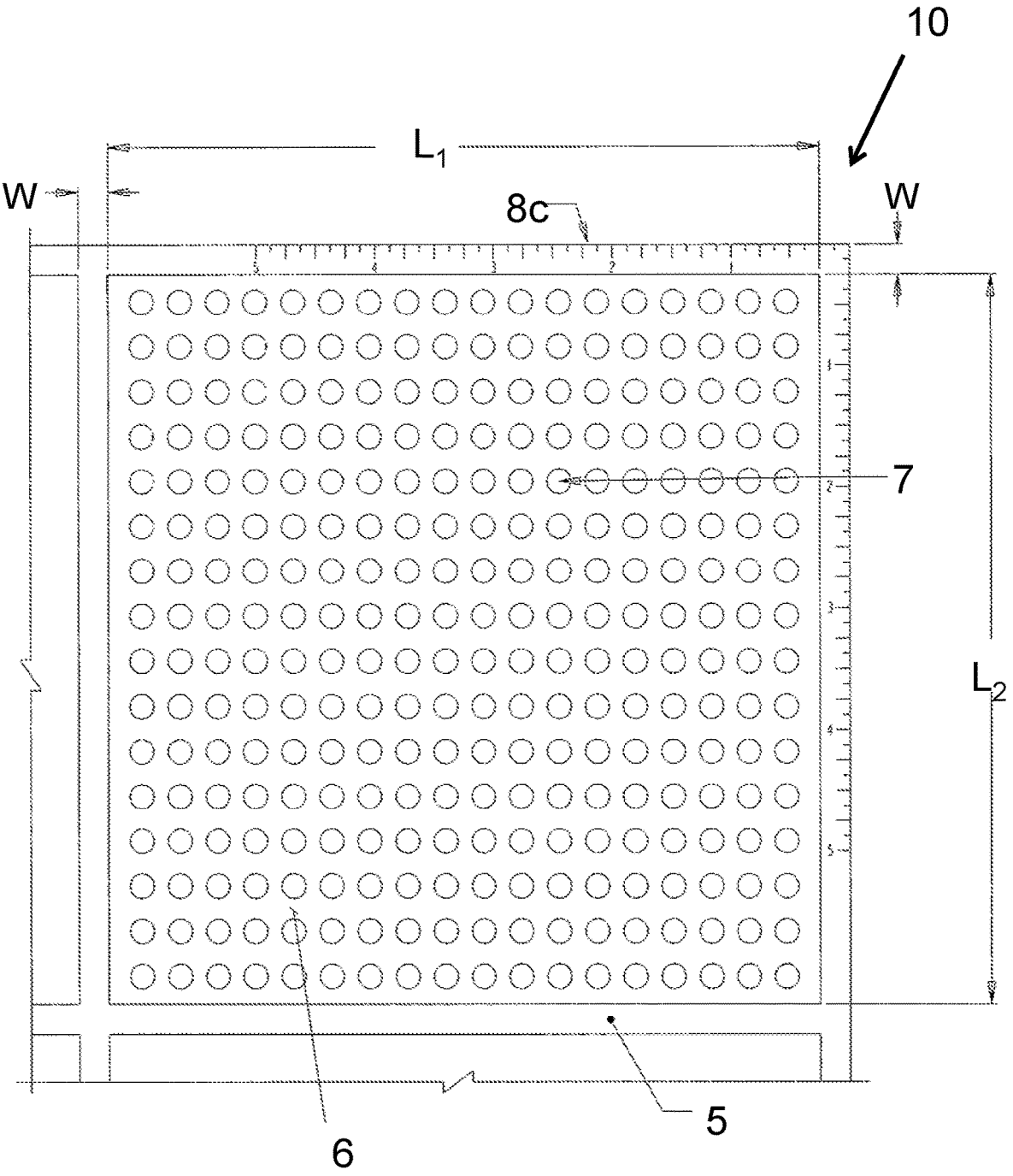
FIG. 3 is a partial perspective view showing an individual tile space and the measured markings imprinted on the colored grout lines throughout the Template according to the present invention.
Figure 4:
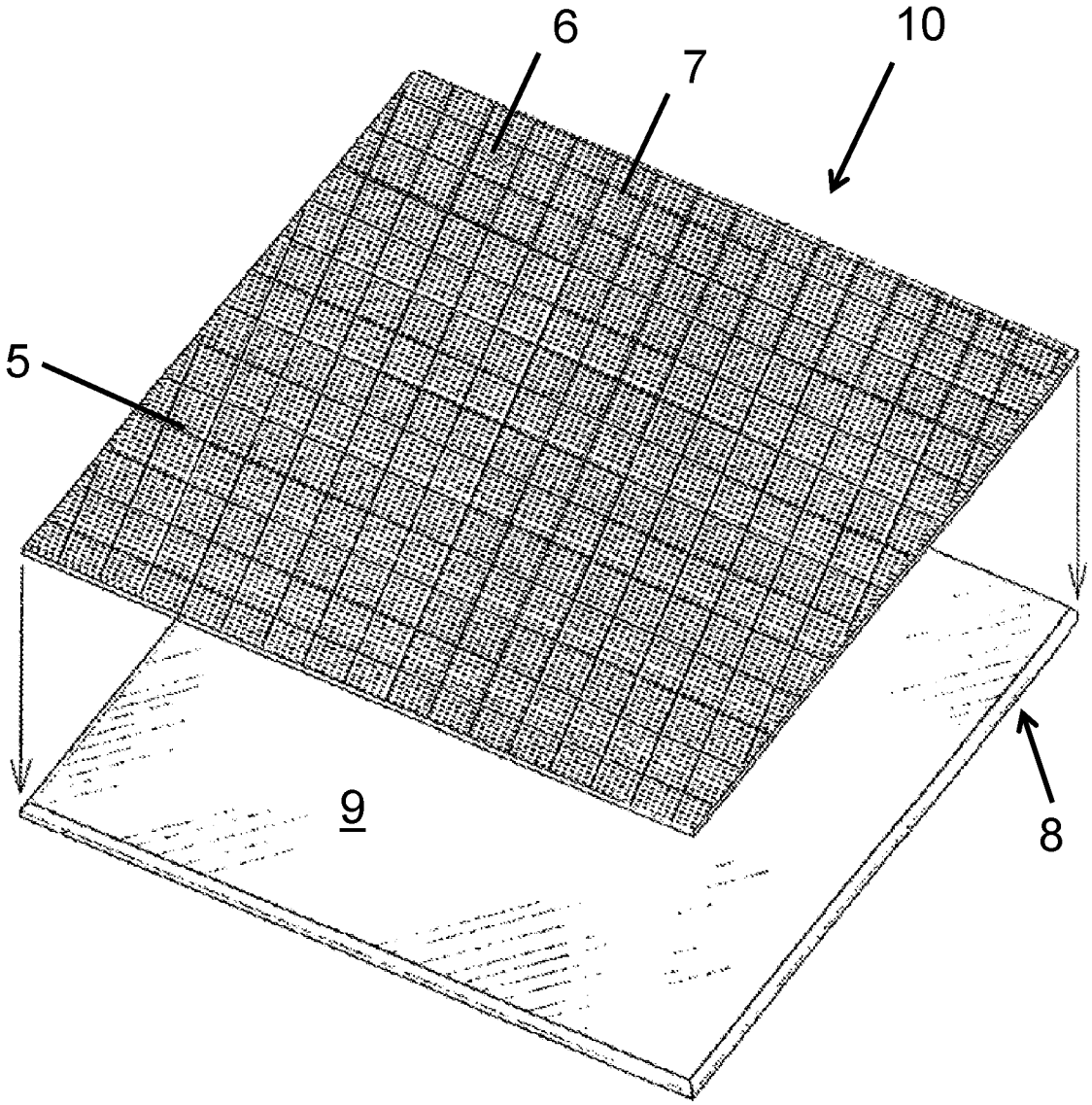
FIG. 4 is an above perspective view showing the tile Template being applied to the subfloor of a room.

In order for the installer to begin the tile installation project, the installer will simply rolls the Template 10 out onto the subfloor 9, as illustrated in FIG. 4, so that the Template 10 is touching each wall in the room 8, as illustrated in FIG. 2. The installer will then reference the measurements 8*c*, as illustrated in FIG. 3 along the colored grout lines 5, as illustrated in FIG. 3, of the end tiles by each wall to ensure the measurements 8*a*, as illustrated in FIG. 1, of the tiles closest to the wall mirrors the measurements 8*b*, as illustrated in FIG. 1, of the end tiles directly across the room/area. The installer completes this process by simply shifting the Template 10 one way or the other. The installer will then replicate the process on the other two walls of the room. Once this is accomplished, the installer will then trim any excess plastic 9*a*, as illustrated in FIG. 2, that may exist beyond the size of the room by cutting the plastic Template 10 along the walls with a sheetrock or carpet razor knife in the same fashion that carpet is cut. The installer will then staple or nail, if nailing preferably with large head roofing nails, the plastic Template 10 to the subfloor 9, as illustrated in FIG. 2 & FIG. 3, in order to stabilize the plastic Template 10 and ensure the Template 10 will not move once installation of the tile begins.

After the Template 10 is stapled to the subfloor and installation begins, the plastic Template 10 is further secured to the subfloor by applying tile glue across the area of the Template 10 during the installation of the tile. Said area, like all areas on the Template consists of factory cut holes 7, as further illustrated in FIG. 2 and FIG. 3, the factory cut holes 7 are spread evenly across the designated tile spaces 6, as illustrated in FIG. 1. These holes 7 remove approximately eighty-percent (80%) of the plastic overlay so when the installer spreads the tile glue eighty-percent (80%) of the glue will adhere directly to the subfloor 9, as illustrated in FIG. 4, and the other twenty percent (20%) will adhere directly to the Template 10 which now becomes permanent with the sub floor. This amount of adhesive applied directly to the subfloor 9 will form the necessary bond to ensure no movement of tile or the tile Template 10 will occur once the tiles are installed. The colored grout lines 5 will also have consistent ruler measurements 8*c*, as illustrated in FIG. 3, imprinted upon them to assist the installer with making any necessary cuts throughout the installation process.

After the Template 10 is secured to the subfloor 9, the installer will then proceed to lay each individual tile in accordance with the designated tile spaces 6 on the Template 10. The Tile Template 10 further simplifies this process for the installer by eliminating the hassle and expense of using tile spacers to create grout lines. Traditionally, professional installers use tile spacers to ensure correct tile placement. However, these spacers are not secured to the subfloor and are dictated by the installer's tile placement. Therefore, the spacers could easily shift or angle throughout the installation process and result in uneven/non-centered tile placement.

The Template 10 thus eliminates the need for individual tile spacers and ensures proper and accurate tile placement simply by following the colored grout lines 5 of the template 10, as illustrated in FIG. 3, that are imprinted upon the Plastic Template 10. The installer will use the colored grout lines 5 as a visual guide to ensure the tiles are laid exactly adjacent to the colored grout lines 5 so that the finished project is perfectly square.

When the installer is installing the end tiles that abut the walls of the room, edge of the area or any fixture or cabinet in the area being tiled, the installer simply refers to the measurements 8*c* imprinted upon the Tile Template 10, as illustrated in FIG. 3, to know the exact end cuts necessary install the end tiles and complete the tile installation. At times an installer will also have to make cuts around secured objects within the room to be tiled, such as toilets, cabinets, islands, etc. The installer will simply cut the Tile Template 10 to fit around such area similar to cutting carpet and then use the measurements 8*c* along the grout lines 5, as illustrated in FIG. 3, to determine the cuts they must make to the surrounding tile. These cuts will not affect the purpose of the tile template 10 of providing the installer with a perfectly square layout which will ensure a professional looking project, because even if a cut has to be sliced along the length or width of the Template 10, once the correct portion of the plastic is removed to fit around the object not being tiled, the Template 10 will simply lie back in place and remain square.

Finally, the Tile Installation Template 10 also simplifies the tile installation process because for the first time an installer (professional or homeowner) can commence installing tile from the far end of an area rather than the center of the room. This can be accomplished because once the Tile Installation Template 10 is secured to the subfloor 9, the center point is already established and the Template 10 therefore designates the entire layout. For this reason, the installer can start installing tile at the easiest location to avoid any chance of having to walk over tile prior to the tile adhering (glue drying) to the floor. This truly simplifies the installation process for anyone laying the tile.

After all of the individual tiles are placed within the designated tile spaces 6, as illustrated in FIG. 1, & FIG. 4, of the colored Template and the tiles have adhered (glue dried) to the floor, the installer will then proceed to spread the grout directly into the grout areas which correspond with the grout line areas 5 of the template 10, as illustrated in FIG. 3.

The invention claimed is:

1. A method for installing tiles onto a subfloor, the method consisting essentially of:

applying a plastic template overlay onto the subfloor, the plastic template overlay a length and a width each greater than a length and a width of the subfloor and comprising:

a plurality of vertical and horizontal lines imprinted on said overlay to form a grid, wherein the grid comprises a plurality of tile spaces formed within intersecting vertical and horizontal lines, the tile spaces having a predefined length and width corresponding to the length and width of a tile, and wherein the vertical and horizontal lines have a predefined width corresponding to the width of grout areas in between said tiles;

measurements imprinted along the plurality of vertical and horizontal lines to provide measurements for end tiles; and a plurality of holes through the overlay and contained within each of the tile spaces configured to allow tile glue to adhere directly to the overlay and directly to the subfloor to secure the tile to the subfloor, wherein the plurality of holes remove approximately eighty percent of the plastic overlay;

adjusting the plastic template overlay by reading the printed measurements on the plastic template to ensure the plastic template overlay is centered in a room in which the tiles are to be laid;

trimming any excess portions of the plastic template overlay extending beyond a wall of the room;

securing the plastic template to the subfloor;

applying adhesive to the plastic template to further and permanently secure the plastic template to the subfloor;

securing said tiles to said template and the subfloor; and installing grout in the grout areas between said tiles.

2. A template for installing tiles onto a subfloor, the template comprising:

a bendable plastic overlay, the bendable plastic overlay comprising a length and a width each greater than a length and a width of the subfloor;

a plurality of vertical and horizontal lines imprinted on said overlay to form a grid, wherein the grid comprises a plurality of tile spaces formed within intersecting vertical and horizontal lines, the tile spaces having a predefined length and width corresponding to the length and width of a tile, and wherein the vertical and the horizontal lines have a predefined width corresponding to the width of grout areas in between said tiles;

measurements imprinted along the plurality of vertical and horizontal lines to provide measurements for end tiles; and a plurality of holes through the overlay and contained within each of the tile spaces configured to allow tile glue to adhere directly to the overlay and directly to the subfloor to secure the tile to the subfloor, wherein the plurality of holes remove approximately eighty percent of the plastic overlay.

3. The template of claim 2, wherein the plurality of vertical and horizontal lines imprinted on said overlay are colored.

4. The template of claim 2, wherein the width of the vertical and the horizontal lines is between 1/16" and 1/2".

* * * * *